United States Patent [19]

Kingsford

[11] 4,332,494

[45] Jun. 1, 1982

[54] ADJUSTABLE COSMETIC WIPER

[75] Inventor: Ted I. Kingsford, Memphis, Tenn.

[73] Assignee: Plough, Inc., Memphis, Tenn.

[21] Appl. No.: 96,710

[22] Filed: Nov. 21, 1979

Related U.S. Application Data

[63] Continuation-in-part of Ser. No. 857,074, Dec. 5, 1977, Pat. No. 4,194,848.

[30] Foreign Application Priority Data

Nov. 30, 1978 [EP] European Pat. Off. ..... 78200323.0

[51] Int. Cl.[3] ..... A46B 11/04

[52] U.S. Cl. ..... 401/5; 132/88.7; 138/45; 401/122; 401/129

[58] Field of Search ..... 401/5, 118, 119, 120, 401/122, 123, 128, 129, 207; 138/45; 132/88.5, 88.7

[56] References Cited

U.S. PATENT DOCUMENTS

| | | | |
|---|---|---|---|
| 204,625 | 6/1878 | Silsbee | 401/122 |
| 3,471,244 | 10/1969 | Melocchi | 401/122 |
| 3,529,899 | 9/1970 | Gruska | 401/121 |
| 3,620,500 | 11/1971 | Santomieri | 138/45 |
| 3,861,810 | 1/1975 | Vasas | 401/122 |
| 3,957,066 | 5/1976 | Dahm | 401/122 |
| 4,194,848 | 3/1980 | Kingsford | 401/122 |

FOREIGN PATENT DOCUMENTS

| | | | |
|---|---|---|---|
| 765719 | 3/1934 | France | 401/122 |

*Primary Examiner*—Clyde I. Coughenour

*Attorney, Agent, or Firm*—Vincent H. Gifford; Bruce M. Eisen

[57] ABSTRACT

A wiper for a cosmetic applicator in which the size of the wiper orifice is adjustable.

21 Claims, 16 Drawing Figures

ADJUSTABLE COSMETIC WIPER

This is a continuation-in-part of application Ser. No. 857,074, filed Dec. 5, 1977, and now U.S. Pat. No. 4,194,848.

This invention relates to an improved device for applying a predetermined metered amount of a cosmetic. More particularly, the device relates to a wiper for a non-rigid mascara applicator, e.g. a brush, in which the quantity of mascara which is retained by the applicator is predetermined by manually adjusting the size of the wiper orifice. This enables a user to reproduce a previous result and to vary the amount of mascara retained by the applicator.

In most mascara products, the applicator is disposed in a mascara mass within the cosmetic container. The excess mascara is removed by an elastic wiper as the applicator is withdrawn from the container. A set amount of cosmetic remains within or on the applicator for application to the eyelashes. In any given application, essentially the same quantity of mascara is retained regardless of the length, thickness or density of the users' lashes, and without regard as to whether the upper or lower lashes are to be treated.

In accordance with the present invention, it will now be possible for the mascara user to retain on the applicator the quantity of mascara suited for her lashes, particularly her upper lashes. A user can therefore apply, at her discretion, either a heavy or thin coating of mascara by merely selecting the volume of mascara which is to be retained on the applicator. The mascara volume is determined by selecting an appropriate diameter or cross-sectional area for the wiper orifice. A user with skimpy, sparsely distributed lashes or one who prefers maximum separation between the lashes will no longer be burdened with the mess associated with an excessive quantity of mascara. A user having a preference for a full or heavy application will now be able to uniformly coat her lashes more rapidly without the need for constant recoating of the applicator. It will also be possible for the user to select the quantity of mascara suited to her lower lashes which are invariably shorter and less dense than the upper lashes. A user can also control the degree to which the individual lashes stick together. For example, for evening use some women prefer the "cluster" or "starry" look which results when the individual lashes stick together in discrete clusters.

Accordingly, it is an object of the present invention to provide a mascara applicator which will enable the user to select the amount of mascara which is to be applied.

It is a further object to provide a mascara applicator which will hold the amount of mascara suited for both the upper and lower lashes of any individual user.

It is a further object to provide a cosmetic applicator which allows a user to reproduce a previous result.

It is a further object to provide a brush-type applicator which will hold a proper amount of a pasty, liquid, semiliquid or powder product in which a predetermined metered amount of the product is to be dispensed.

Figure 1:
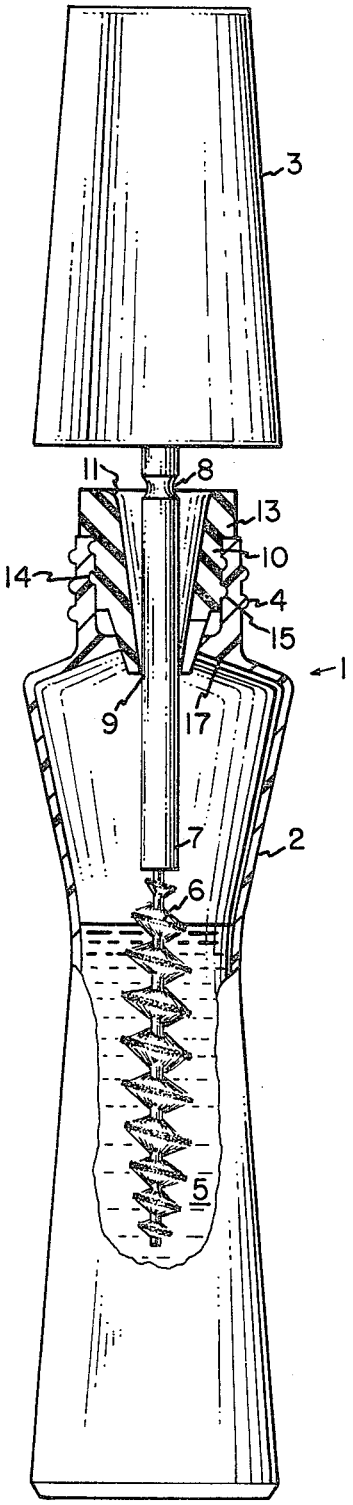
FIG. 1 is a longitudinal sectional view of an adjustable wiper within a fully assembled mascara container.

Referring to FIG. 1, there is illustrated an eyelash cosmetic package 1 that consists of a container or tubular reservoir 2 and a cap 3. The cap 3 is provided with internal threads (not visible) which mesh with the external threads 4 of container 2. The container is shown partly filled with a cosmetic composition 5.

A non-rigid mascara applicator 6, e.g., a brush, is attached to the cap 3 by a shaft or rod 7 with the cap serving as a handle for the applicator. The shaft 7 has a reduced portion 8 which is adjacent to the wiper orifice 9 when the closure is fully tightened onto the container. This minimizes any deforming stress on the wiper when it is not in use.

The wiper 10 comprises a tubular frame which is positioned within the neck of the container. The interior wall 11 of the wiper is tapered toward the bottom of the container. The wiper has an integral dial ring 13 at one end and a wiper orifice 9 at the other end. The wiper has a guide means 14 which mates with a corresponding guide means 15 in the wall of the container neck. In FIG. 1 the guide means is shown as a screw thread. The wiper contains at least one longitudinal slit 16. The bottom of the frame is within the opening formed by container ledge 17. At least a portion of the wiper 10 would be located within the container 2, preferably within the neck of the container.

Rotation of the dial ring 13 moves the wiper longitudinally within the container, thereby changing the diameter of the wiper orifice 9 as it is compressed or expanded by the ledge 17. The longitudinal slit(s) 16 relieves the compression of the wiper mass and permits the wiper orifice to change in diameter while maintaining a generally circular configuration. The preferred embodiment would have at least four longitudinal slits which diverge toward the bottom of the container when it is assembled.

Figure 2:
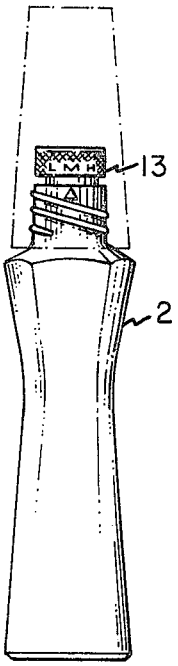
FIG. 2 is a longitudinal view of the mascara container of FIG. 1.

FIG. 2 shows a cosmetic container having three indicia for the diameter or cross-sectional area of the orifice. Each of the indicia correspond to a specific, preselected, reproducable orifice size. On the "L" (Low) setting the wiper orifice would have a minimum cross-sectional area so that only a small amount of cosmetic is retained by the applicator. On the "H" (High) setting the wiper orifice would have a maximum cross-sectional area, thereby leaving a large quantity of cosmetic.

The "M" setting would be a medium position. Obviously any number of settings could be used. The settings provide a means to allow the user to reproduce a previous use.

Figure 3:
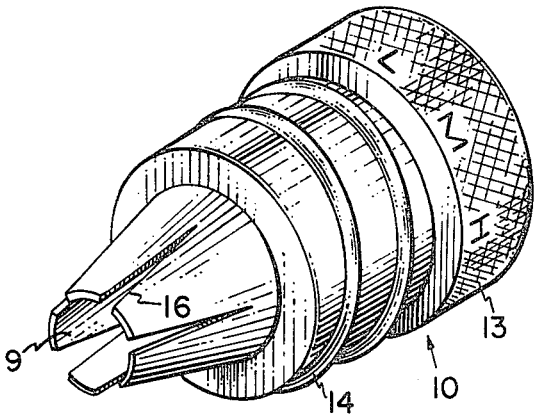
FIG. 3 is an enlarged perspective view of the wiper shown in FIG. 1.

FIG. 3 is a perspective view of the wiper shown in FIG. 1.

Figure 4:
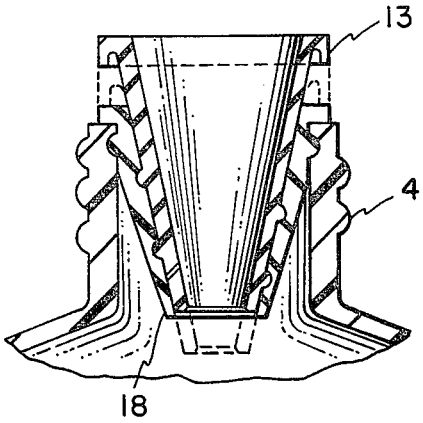
FIG. 4 is a cross-sectional view of a wiper variant within the container neck.

FIG. 4 is a sectional view of another wiper embodiment positioned within the container neck. The wiper is similar to the FIG. 1 embodiment except that it is supported by a sleeve means 18. The sleeve is positioned between the wiper and the container neck and comprises a tubular member which is tapered toward the bottom of the container. Rotation of the dial ring relative to the container moves the wiper longitudinally and changes the diameter of the wiper orifice. The dotted lines show the position of the wiper when adjusted to its minimum orifice size.

Figure 5:
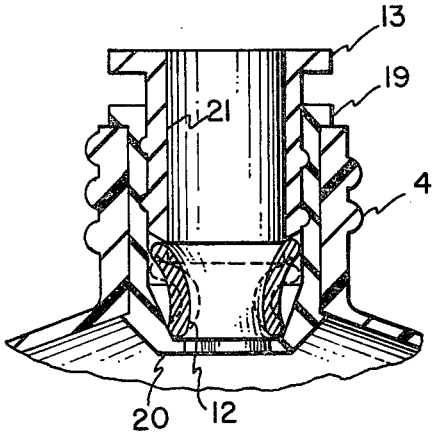
FIG. 5 is a cross-sectional view of another wiper variant within the container neck.

FIG. 5 is a side view of another wiper embodiment in the container neck. The wiper 12 is supported by a longitudinal sleeve 19 having a ledge 20. The wiper 12 is compressed by a driving member 21 which is located above the wiper. Rotation of the driving member will compress the wiper to the position shown by dotted lines.

Figure 6:
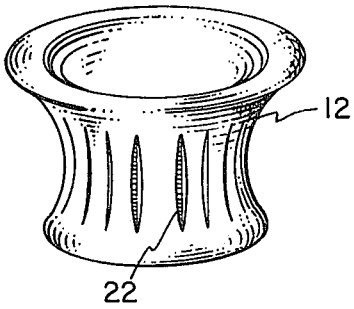
FIG. 6 is a perspective view of the FIG. 5 wiper.

FIG. 6 is a perspective view of the wiper 12 shown in FIG. 5. The wiper is a doughnut shaped annulus containing a series of longitudinal slits 22 in the outer wall of the annulus. The slits, which preferably extend only partly through the wiper, relieve the compression of the mass. At least four of the slits uniformly spaced about the wiper are preferred. Alternatively, the slits could be located on the inner surface of the wiper or cut through the entire wiper mass.

Figure 7:
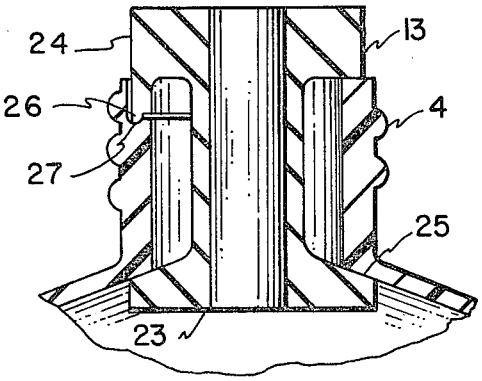
FIG. 7 is a cross-sectional view of another wiper variant.
Figure 8:
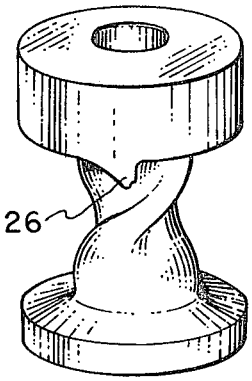
FiG. 8 is a perspective view of the wiper of FIG. 7 as it is twisted.

FIGS. 7–8 show another embodiment of wiper consisting of a tubular frame. The bottom 23 of the frame is fixed to the container at 25 by an adhesive or similar means. The top 24 of the frame is free to rotate relative to the container. Rotation of the top portion of the wiper to the twisted position shown in FIG. 8 restricts the cross-sectional area of the wiper orifice. The wiper is held in position by a detent 26 which fits in a corresponding indent in the container wall. A series of indents corresponding to each setting on the wiper would be provided.

Figure 9:
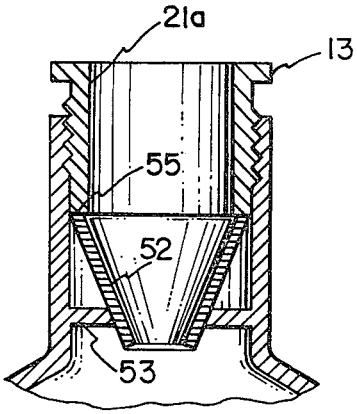
FIG. 9 is a cross-sectional view of another wiper variant.
Figure 10:
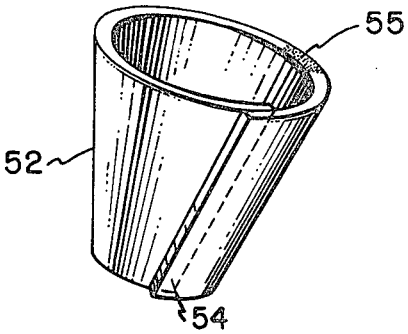
FIG. 10 is a perspective view of the FIG. 9 wiper.

FIG. 9 is a side view of another wiper embodiment in the container neck. The wiper 52 comprises a split truncated cone which overlaps itself at 54. A driving member 21*a* is either integral with or attached to the top of the wiper with an adhesive 55 or similar means. The bottom of the wiper is within the opening formed by container ledge 53. Rotation of dial ring 13 moves the wiper longitudinally and changes the diameter of the wiper as it is compressed or expanded by the ledge 53. If the wiper material is sufficiently resilient the adhesive 55 could be eliminated.

Figure 11:
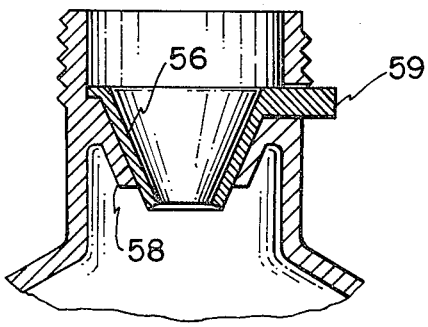
FIG. 11 is a cross-sectional view of another wiper variant.
Figure 12:
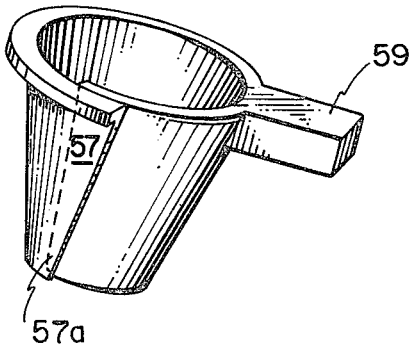
FiG. 12 is a perspective view of the FIG. 11 wiper.

FIG. 11 is a side view of another wiper embodiment similar to the FIG. 9 embodiment. The wiper 56 is a split, truncated cone which overlaps itself at 57. The cone is anchored to guide 58 by an adhesive or other means along the outer overlap portion 57*a*. An integral dial ring 59 is attached to the cone near the inner overlap portion. Rotation of the cone by moving the dial ring 59 changes the size of the wiper orifice. The wiper can be held in position by detents similar to the ones described in relation to FIG. 7.

Figure 13:
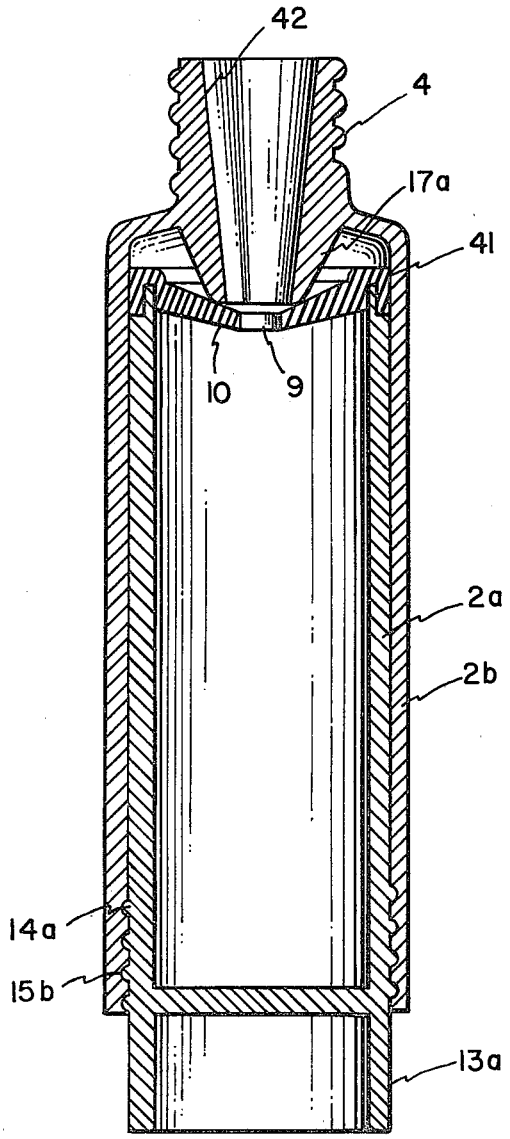
FIG. 13 is a cross-sectional view of another embodiment.

FIG. 13 is a sectional view of another embodiment in which the container consists of a reservoir 2*a* and a reservoir cover 2*b*. The adjustment of the diameter of the wiper orifice 9 is achieved by rotation of the reservoir 2*a* relative to the cover 2*b*.

The wiper 10 comprises an integral ring 41 which is attached to the top of reservoir 2*a*. The interior and exterior walls of the wiper are preferably tapered toward the bottom of the reservoir 2*a*. The center of the wiper has an orifice 9. The wiper may contain at least one longitudinal slit which relieves the compression of the wiper mass and permits the wiper orifice to change in diameter while maintaining a generally circular configuration. The neck of the container is integral with cover 2*b*. The interior surface 42 of the container neck extends into the container thereby forming an abutting means or ledge 17*a* which is positioned adjacent the wiper orifice 10. The reservoir 2*a* has a guide means 14*a* which mates with a corresponding guide means 15*a* in the cover 2*b*. In FIG. 13 the guide means is shown as a screw thread.

Rotation of the dial ring 13*a* moves reservoir 2*a* longitudinally relative to cover 2*b*, thereby exerting or relieving pressure on wiper 10 from ledge 17*a*. As the pressure on wiper 10 becomes greater, the diameter of the wiper orifice 9 enlarges and less cosmetic composition is wiped off the applicator when withdrawn from the container.

Figure 14:
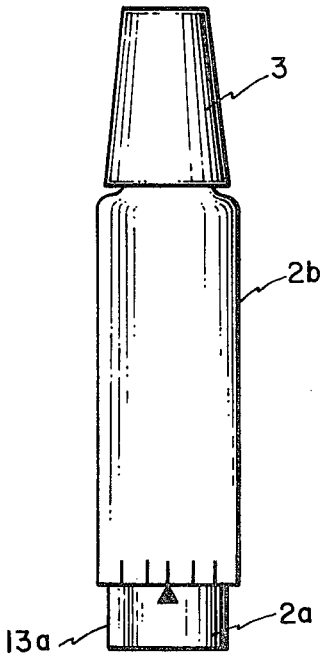
FIG. 14 is a longitudinal view of the mascara package of FIG. 13.

FIG. 14 is a side view of the cosmetic container shown in FIG. 13. The bottom of the container has indicia similar to the FIG. 2 embodiment.

Figure 15:
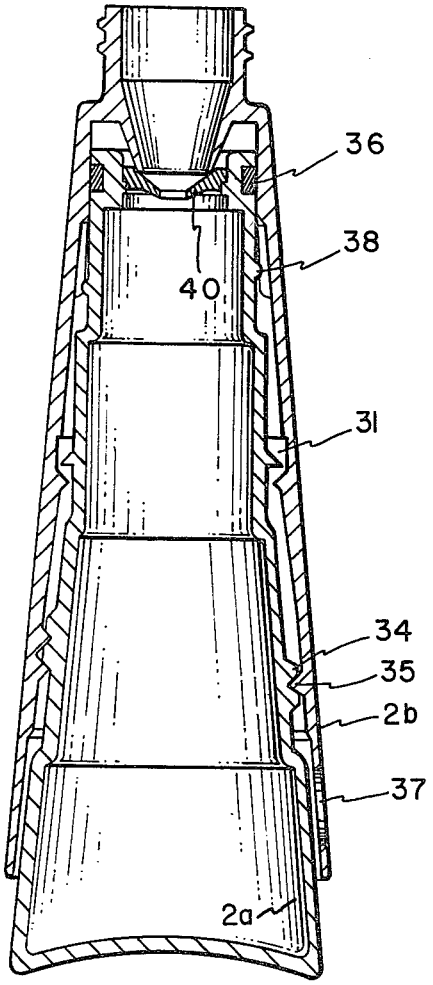
FIG. 15 is a cross-sectional view of a preferred embodiment similar to FIG. 13.
Figure 16:
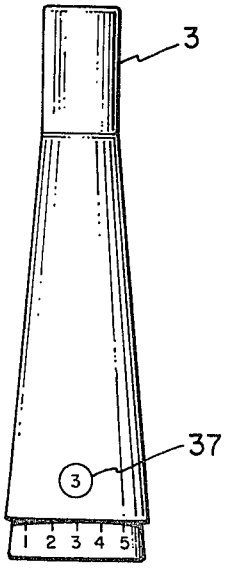
FIG. 16 is a longitudinal view of the mascara package of FIG. 15.

The preferred FIGS. 15 and 16 embodiment is similar to the FIG. 13 embodiment but additionally contains several safety features which prevent accidental leakage and accidental spilling of the cosmetic composition. This embodiment contains a sealing flange 36 which prevents leakage during storage between cover 2*b* and the top of the reservoir 2*a*. In the preferred embodiment flange 36 is integral with the wiper. It also contains stops 31 which prevent a user from accidentally disengaging the screw threads 34 and 35 during use. In this embodiment all but the selected orifice indicia are hidden. The selected indicia is visible through aperture 37. Screw thread 38 provides added support between the reservoir 2*a* and cover 2*b*.

The non-rigid applicator head is preferably a radial bristle brush such as shown in U.S. Pat. Nos. 3,214,782 and 3,870,186. Other non-rigid applicators such as the longitudinal bristle brush shown in U.S. Pat. No. 3,883,254; the foam tipped applicator as shown in U.S. Pat. No. 3,908,675; or the variable applicator shown in U.S. Pat. No. 3,998,235 would also be suitable. The wiper is preferably made of an elastomeric or a thermoformed plastic material having a slight resiliency.

The preferred mascara package is a mascara product in which the applicator is an elongated radial bristle brush having a tapered head, an overall diameter of 3–10 mm and an overall length of 5–35 mm. The wiper orifice has a cross-sectional area which can be varied between 6 and 15 $mm^2$. In the case of a substantially circular orifice, the orifice diameter would generally be varied between 2.5 and 4.5 mm. The mascara composition could be either solvent or water based.

The wiper disclosed herein can be used in a variety of applications other than for mascara. For example, it could be used to control the amount of material used in coloring an eyebrow, moustache, beard or hair upon the head, or to meter the amount of any pasty, liquid, semi-liquid or powder product which is a cosmetic, medicament or otherwise.

While several embodiments have been shown to illustrate the invention, it will be understood by those skilled in the art that various changes and modifications can be made without departing from the scope of the invention.

I claim:

1. A package comprising:
   a. a container comprising a reservoir and a cover overlapping at least a portion of the side of said reservoir wherein said cover contains the container neck, said reservoir having fluent material therein;
   b. a container closure;
   c. a wiper having an orifice means defining a single continuous wiping surface adapted to wipe excess material from the applicator;
   d. an applicator attached to said closure by a shaft and adapted to be passed through said wiper orifice and immersed in said fluent material when said closure is attached to said container;
   e. a calibrated adjusting means to vary the cross sectional area of said orifice; said adjusting means comprising an abutting means positioned adjacent to said wiper orifice and a guide means adapted to control the amount of pressure exerted on said wiper by said abutting means, said adjusting means permitting a user to reproduce a previous result.

2. A package as in claim 1 wherein said fluent material is a cosmetic composition.

3. A package as in claim 1 wherein said abutting means is a ledge extending from the neck of said cover.

4. A package as in claim 1 wherein said wiper is positioned across the top of said reservoir.

5. A package as in claim 1 wherein said guide means comprises a first guide means on the outside wall of said reservoir and a second mating guide means on the inside wall of said cover.

6. A package as in claim 5 wherein said first and second guide means comprise a screw thread.

7. A package as in claim 1 wherein said calibrated adjusting means further comprises:
   a. an indicating means comprising a plurality of indicia, each indicia corresponding to a different orifice cross-sectional area, and
   b. a means to position said indicia to correspond to the selected orifice cross-sectional area.

8. A package as in claim 7 wherein at least a portion of said indicating means is located on said reservoir.

9. A package as in claim 8 wherein said cover has an aperture through which said selected indicia is visible.

10. A package as in claim 1 wherein said applicator is a radial bristle brush.

11. A cosmetic package as is in claim 10 wherein said brush has an overall diameter of 3–10 mm and an overall length of 5–35 mm.

12. A cosmetic package as in claim 1 wherein said fluent material is a cosmetic composition and said adjusting means is adapted to adjust the cross-sectional area of the orifice between 6 and 15 $mm^2$.

13. A cosmetic package as in claim 12 wherein said applicator is made of a compressible foam material.

14. A cosmetic package as in claim 12 wherein said orifice is substantially circular.

15. A cosmetic package as in claim 12 wherein said cosmetic composition is a pasty, liquid or semi-liquid material.

16. A cosmetic package as in claim 12 wherein said cosmetic composition is a powder.

17. A cosmetic container comprising:
   a. a reservoir adapted to hold a cosmetic composition
   b. a wiper having an orifice means adapted to wipe excess cosmetic composition from an applicator, said wiper positioned across the top of said reservoir,
   c. a cover overlapping at least a portion of the side of said reservoir, said cover comprising the container neck, a skirt and an abutting means, said abutting means positioned adjacent to said orifice means,
   d. a calibrated adjusting means to vary the cross-sectional area of said orifice, said adjusting means comprising a guide means adapted to control the amount of pressure exerted on said wiper by said abutting means.

18. A cosmetic container as in claim 17 wherein said skirt overlaps a substantial portion of said reservoir.

19. A cosmetic container as in claim 17 wherein said abutting means extends downwardly from the container neck.

20. A cosmetic container as in claim 17 wherein said calibrated adjusting means further comprises:
   a. an indicating means comprising a plurality of indicia, each indicia corresponding to a different orifice cross-sectional area, and
   b. a means to position said indicia to correspond to the selected orifice cross-sectional area.

21. A cosmetic container as in claim 20 wherein said indicating means is located on said reservoir and said cover has an aperture through which said selected indicia is visible.

* * * * *